United States Patent [19]

Schroder et al.

[11] B 3,989,071

[45] Nov. 2, 1976

[54] GAS LIGHTER

[75] Inventors: Adolf Schroder, Kelkheim; Hans Dieter Klauer, Wehrheim, both of Germany

[73] Assignee: Braun Aktiengesellschaft, Frankfurt am Main, Germany

[22] Filed: May 28, 1974

[21] Appl. No.: 473,813

[44] Published under the second Trial Voluntary Protest Program on March 9, 1976 as document No. B 473,813.

[30] Foreign Application Priority Data

June 18, 1973 Germany ..... 2330960

[52] U.S. Cl. ..... 141/294; 141/349; 141/354; 431/344

[51] Int. Cl.[2] ..... B65B 1/04

[58] Field of Search ..... 431/344; 222/3; 141/293, 294, 295, 354, 349; 251/64

[56] References Cited

UNITED STATES PATENTS

| | | | |
|---|---|---|---|
| 3,044,505 | 7/1962 | Iketani | 141/294 |
| 3,159,991 | 12/1964 | Maltner et al. | 431/344 |
| 3,217,762 | 11/1965 | Burchett | 141/293 |
| 3,341,082 | 9/1967 | Meshberg | 251/64 |
| 3,391,716 | 7/1968 | Projahn | 141/295 |
| 3,746,301 | 7/1973 | Budzich et al. | 251/64 |

*Primary Examiner*—Kenneth W. Sprague
*Assistant Examiner*—James C. Yeung
*Attorney, Agent, or Firm*—Ernest F. Marmorek

[57] ABSTRACT

A gas lighter of the type having a tank, a filler valve and a valve head which is biased by a spring to press normally against a seal surface. In order to make sure that there is enough space above the liquid fuel to permit expansion of the fuel a predetermined dimension H is provided above the fuel in the tank. This is accomplished by selecting the length of the filler valve housing to correspond to this dimension H. In addition, the closing movement of the valve head is delayed or retarded by introducing friction into the movement of the valve which permits a portion of the liquid fuel to blow off. The delay device may be determined by force or by the shape of the friction surfaces.

5 Claims, 6 Drawing Figures

GAS LIGHTER

BACKGROUND OF THE INVENTION

This invention relates generally to gas lighters of the type having a tank and a filler valve and particularly to such lighters having a valve head biased by a spring and urged against a seal surface.

Such gas lighters are well known in the art. During the filling position of the lighter the valve housing extends from the upper cover wall into the interior space of the tank so that a portion of the space of the tank is disposed above the lower edge of the valve housing which is usually identical with the seal surface.

It would be desirable to maintain this portion of the interior space of the tank free of the liquified gas so that a gas buffer exists in this space which permits an expansion of the liquid gas under the influence of increased temperatures.

Even if such a gas buffer could be formed there is no guarantee that this buffer is sufficiently large. Due to reasons which will be more fully explained hereinafter the size of the gas buffer immediately after the filling process depends from that dimension H by which the valve housing extends into the space of the tank. This dimension H in the past has been selected arbitrarily or solely for reason of construction details of the filler valve and has not been determined by the geometry of the tank. If the dimension H is too small it cannot be excluded that during elevated ambient temperatures an intolerable high hydrostatic pressure builds up.

Independently from these causes it has been found that while utilizing those gases which are suitable for gas lighters that it is possible to fill this portion of the space of the tank which has just been defined up to a minute gas bubble with the liquid gas. Accordingly, there is practically no space left for an expansion of the fuel. The result is that even for a small increase of temperature a considerable hydrostatic pressure builds up in the tank which can lead to a destruction of the tank. The danger of a temperature increase for a completely filled gas lighter is particularly large because the lighter may, for example, be carried in a pants pocket or may be left in an automobile, the interior of which may assume rather high temperature due to sunlight.

It is accordingly an object of the present invention to provide a gas lighter of the type discussed which prevents the creation of an undesirable high hydrostatic pressure in the tank of the lighter.

SUMMARY OF THE INVENTION

In accordance with the present invention a gas lighter has such a length of the housing of the filler valve so that it extends into the space of the tank by the dimension H. Accordingly, the gas lighter during the filling position has a volume of the tank above a plane extending through the lower edge of the valve housing whereby a gas space is provided which can take care of the entire increase of volume of the liquid gas caused by a temperature increase within usual ambient temperatures.

By applying the rule in accordance with the present invention it is sufficient after the filling process to press down the valve stem by hand in order to generate a sufficiently large gas buffer. It has been found that a relatively short period of time of a few tenths of a second is sufficient in order to cause the liquid gas contained above the lower edge of the valve housing, that is the so-called overflow amount, to be forced outside in liquid form under the influence of the gas pressure existing in the space of the tank and through the opening of the valve. After the overflow amount has been blown out, further gas can only issue from the filler valve in a gaseous state. To this end, a corresponding amount of the liquid gas must first be evaporated. This is a very slow process compared to the blowing out of the liquid gas and does not cause a substantial loss of liquid gas.

In order to guarantee the formation of a sufficiently large gas buffer independently of the care taken during the filling and the airing process, it is further proposed, in accordance with the present invention, to provide the valve stem with a device for delaying or retarding the closure motion. The different forms of such a delay device will be subsequently described in connection with the embodiments of the invention. They may have the form of purely force controlled friction surfaces, but also may consist of detent means which generate a force directed opposite the one which must be overcome during the closure motion. It will be understood that a combination of force controlled and form controlled delay devices may be utilized.

For a filler valve without a delay device the valve stem follows the filler stem during its return motion while maintaining the seal between the filler stem and the lighter or the filler valve so that no gas can escape. When using a filler valve on the other hand with a delay mechanism, there exists a short period of time between the removal of the filler stem of the filling bottle and the closure of the filling valve during which the filler valve is open. The duration of this period of time may be controlled by a selection of the corresponding delay factor and may be brought to an optimum value. It has been found that when using a filler valve with delay device, even when the space of the tank has been overfilled, there is created automatically a precisely defined gas buffer in the space of the tank related to the volume, the magnitude of which is controlled by the length of the valve housing extending into the tank space.

The size of the dimension H which depends upon the geometry of the tank, can be readily determined by simple experiments.

A gas buffer of suitable dimension safely prevents the occurrence of a hydrostatic overpressure so that a gas lighter having this feature is safely protected against destruction of the tank during the temperature increases which are to be expected. This also avoids a possible damage to the burner valve which may result from the influence of too high an inner pressure. The number of complaints due to tanks which have become leaky is substantially reduced.

The novel features that are considered characteristic of this invention are set forth with particularity in the appended claims. The invention itself, however, both as to its organization and operation, as well as additional objects and advantages thereof, will best be understood from the following description when read in connection with the accompanying drawings.

DESCRIPTION OF THE PREFERRED EMBODIMENTS

Figure 1:
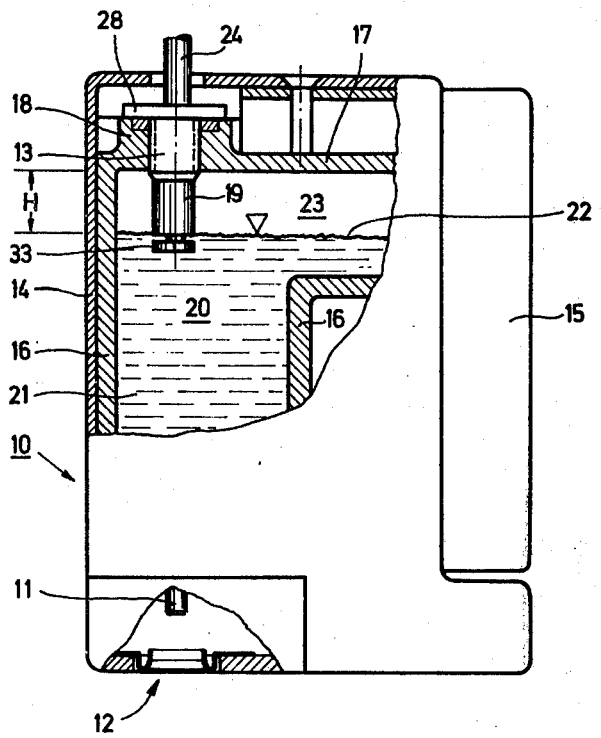
FIG. 1 is a side elevational view, partly in section, of a complete gas lighter embodying the invention in the filling position.

Referring now to the drawings wherein like elements are designated by the same reference characters, and particularly to FIG. 1, there is illustrated a gas lighter 10 which is shown in the filling position. In other words, the burner nozzle 11 and the flame exit opening 12 are directed downwardly while the filler valve 13 is directed upwardly. The gas lighter 10 consists of a housing 14 having a push button 15 which serves the purpose to operate the igniter and the burner valve not shown in the drawing in order to avoid confusion. These devices are not subject of the present invention and have therefore been omitted. In the interior of the housing 14 there is disposed a tank 16 having an upper tank wall 17 in the position shown in FIG. 1 which is provided with a threaded nipple 18 for receiving the threaded filler valve 13. The filler valve 13 has a valve housing 19 which extends into the space 20 of the tank by the distance H. A predetermined amount of the liquid gas 21 is in the tank space 20. In view of the previously discussed operation which will be more fully explained hereinafter of the filler valve 13, there exists in the position shown in FIG. 1 a liquid level 22 above which exists a defined gas space 23 of the liquid gas 21. The height of this gas space 23 is identical with the dimension H. This gas space is formed if the tank 15 should be filled too much by a blowout of the so-called overflow amount.

Figure 2:
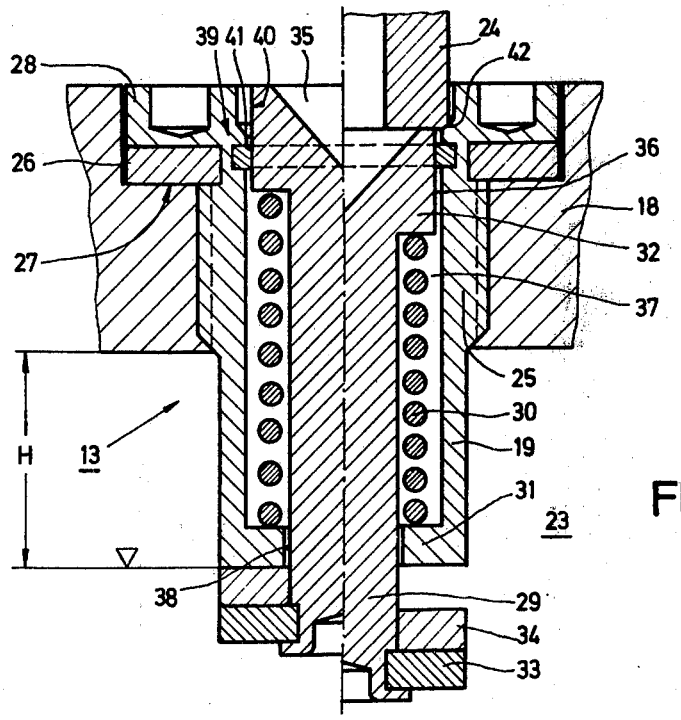
FIG. 2 is a section through a complete filler valve on enlarged scale, the left-hand portion of the figure showing the filler valve in the closed state and the right-hand portion in the open state.

FIG. 2 illustrates details of the filler valve 13. It should be noted that the right-hand portion shows the valve in the open position during filling with a filling bottle of which only the filler stem 24 has been illustrated. The valve housing 19 includes a cylindrical portion which extends into the space of the tank by the dimension H. It will be apparent that this dimension can be accommodated to the size of the lighter and accordingly to the magnitude of the required gas space 23. The valve housing 19 continues into a threaded sleeve 25 by means of which it is screwed into the threaded nipple 18 of the tank 16. For sealing purposes there is provided an annular seal 26 which is compressed between a shoulder 27 and an annular flange 28 disposed at the valve housing 19. In the valve housing there is provided a valve stem 29 which is normally urged by a closure or closing spring 30 into the closed position, that is as long as it is not urged from the outside. The closing spring 30 rests on the one hand against a collar 31 of the valve housing 19 and on the other hand against an annular shoulder 32 of the valve stem 29. The valve stem 29 is provided with a valve head 33 which is provided with a seal ring 34. The upper annular surface of the seal ring 34 and the lower annular surface of the valve housing 19 form the two cooperating seal surfaces.

The portion of the valve stem 29 extending toward the outside is provided with a V-shaped cutout 35 which extends over the entire cross-section of the valve stem 29. As a result, the valve stem 29 cannot close the filler stem 24 of the filler bottle. The liquid gas passes through the V-shaped cutout 35 in the corresponding large annular space 36 between the valve stem 29 and the valve housing 19 and then flows through an annular space 37 within which the closure spring 30 is disposed and from there through a correspondingly large annular slit 38 into the actual space of the tank.

In the embodiment of FIG. 2 there is provided a delay device 39 which consists of a friction ring 41 which slides between the valve housing 19 and the valve stem 29 over a cylindrical surface 40. The friction ring may have a rectangular cross-section. However, it may also be formed as a round or O-ring. The position of the friction ring 41 and the depth of the V-shaped cutout 45 must be so selected that the flow path of the gas is not impeded at least not over the major portion of the structure of the valve stem. It will be evident from FIG. 2 that the filling channel formed by the V-shaped cutout 35 and the annular slit 36 is not quite closed by the friction ring 41 even when the filler valve is in a closed position. The closure of the valve is effected by the valve head 33 with the seal ring 34. For the filler process illustrated in the right-hand portion of FIG. 2 the necessary seal takes place between the filler stem 24 and a conical shoulder 42 of the valve housing 19. Without the presence of a delay device 39, the valve stem 29 would follow the filler stem 24 when it is withdrawn and would immediately close again the flow path of the gas because the seal ring 34 would seat at the lower annular surface of the valve housing 19. The escape of an appreciable amount of liquid gas would therefore be impossible. In view of the presence of the delay device 39 the valve stem 29 can follow the filler stem 24 only with a delay. This means that the seal between the filler stem 24 and the conical shoulder 42 does not take place until the valve stem can reach the position shown in the left-hand portion of the figure. Until this state has been reached - the time duration can be influenced by a suitable selection of the friction ring 41 - the direction of flow of liquid gas within the filler channels 35, 36, 37 and 38 reverses, and the overflow amount of the fuel contained within the tank is blown outside. It is also possible to arrange the friction ring 41 as a lip seal ring in which case the seal ring 34 may be omitted. In such a case care must be taken that the depth of the V-shaped cutout 35 is correspondingly decreased so that the lowest point of the cutout is covered by the lip seal ring in the closure position.

Figure 3:
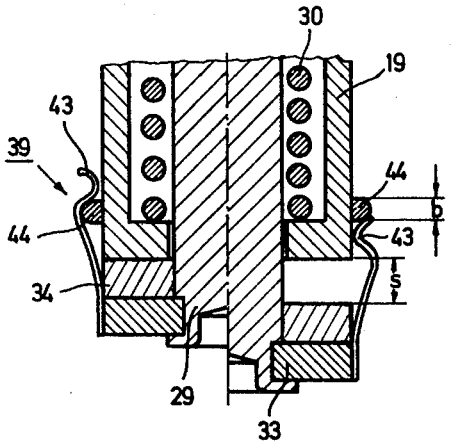
FIGS. 3–6 are sectional view similar to that of FIG. 2 through the lower portion of the filler valve extending into the interior space of the tank and provided with different delay devices in accordance with the present invention.

Another embodiment of the invention is illustrated in FIG. 3. Here the delay device 39 consists of one or several elastic detents 43 secured to the valve stem 29 and circumferentially distributed. It further includes a corresponding protrusion 44 disposed at the valve housing 19. The position and shape of the detent and protrusion are such that the closure motion of the valve stem 19 is only possible by overcoming the forces created between these two elements. The right-hand portion of FIG. 3 shows the filler valve before the closure where the elastic detent 43 seats ahead of the annular bulge or protrusion 44. In order to terminate the closure motion under the influence of the closure spring 30, an increased force is required because the elastic detent 43 must be laterally bent by the height of the bulge 44 in order to overcomee the detent means. This increased requirement of force and the resultant friction causes a delay of the closure motion. After having overcome the bulge 44, the detent 43 is disposed above the bulge 44 so that the closure force of the spring 30 is not influenced. In order to obtain an optimum action of the delay device, it is necessary that the height b of the bulge 44 is smaller than the stroke s of the valve stem 29.

Figure 4:
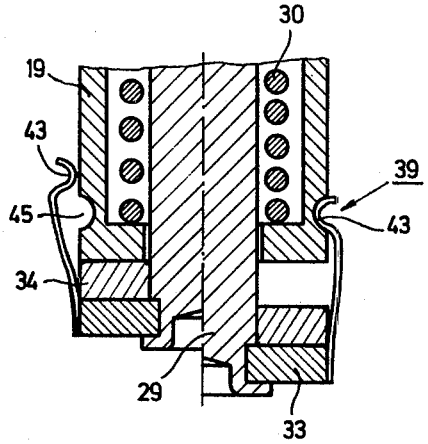

Similar considerations apply to the embodiment of FIG. 4 where instead of a raised bulge 44 as shown in FIG. 3, there is provided a deeper notch 45 which extends circumferentially. The elastic detent 43 has essentially the same shape and function.

Figure 5:
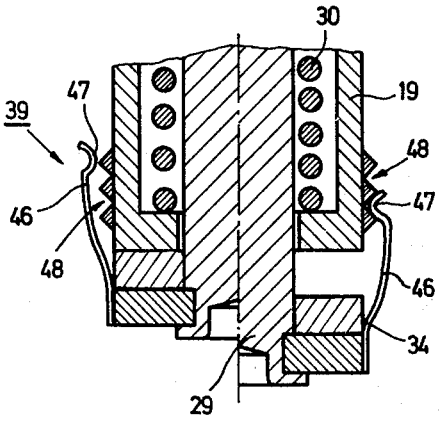

According to the embodiment of FIG. 5 there is illustrated a delay device 39 consisting of a sliding spring 46 disposed at the valve stem 29 having a sliding surface 47 which cooperates with a friction surface 48 at the valve housing. The friction surface 48 has been schematically illustrated as consisting of a plurality of rather large detents or bulges. In principle it is sufficient to provide a roughened surface by means of which a force is generated which is opposed to the force of the closure spring 30 during the closure motion of the valve stem 29 and which causes a delay of the closure motion.

Figure 6:
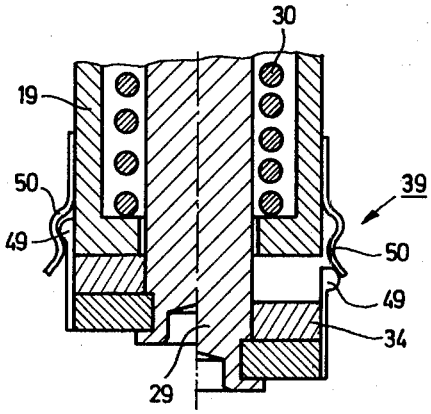

In the embodiment of the invention of FIG. 6, the delay device consists of several cam rams 49 circumferentially disposed about the valve stem 29 as well as the corresponding number of springs 50 disposed at the valve housing 19. The position and shape of the two elements is so selected that closure of the valve stem is only possible after overcoming the resistance of the delay device. The right-hand portion of FIG. 6 again shows the beginning of this process where the cam ram 49 seats against the outwardly extending surface of the spring 50 so that the spring must be further bent outwardly during further motion of the cam ram 49 and by overcoming the resulting force. Also, by this means a delay of the closure process is effected. The termination of the closure motion is again shown in the left-hand portion of FIG. 6. In this position the delay mechanism does not generate any forces which could impede the action of the closure spring 30. The resistance only occurs during the closure motion.

What is claimed is:

1. A gas lighter comprising in combination:

a. a tank;

b. a filler valve including a valve housing extending into the interior space of said tank; and c. a valve stem axially and rectilinearly movable and cooperating with said valve housing;

d. said valve stem being biased by a closure spring, said valve stem having a seal surface, the length of said valve housing being so selected that it extends by a dimension H into the interior space of said tank so that when said lighter is in the filling position there exists a volume in said tank above a plane passing through the lower edge of said valve housing, said tank volume being capable of containing a gas which will accommodate the increase of volume of a liquid gas in said tank due to an increase of temperature within the usual ambient temperature ranges;

e. said valve stem including a delay device for delaying the closure motion thereof.

2. Gas lighter as defined in claim 1 wherein said delay device consists of a friction ring slidable over a cylindrical surface between said valve housing and said valve stem.

3. Gas lighter as defined in claim 1 wherein said delay device consists of at least one elastic detent disposed at said valve stem and a corresponding projection disposed at said valve housing, the position and shape of said detent and said projection being such that the closing motion of said valve stem is only possible by overcoming the friction generated thereby.

4. Gas lighter as defined in claim 1 wherein said delay device consists of at least one sliding spring disposed at said valve stem and a friction surface disposed at said valve housing, the sliding surface of said spring cooperating with said friction surface.

5. A gas lighter as defined in claim 1 wherein said delay device consists of at least one cam ram disposed at said valve stem and a corresponding spring disposed at said valve housing, the position and shape of said cam ram and said spring being such that the closing motion of said valve stem is only possible by overcoming the friction caused thereby.

* * * * *